United States Patent [19]

Saito

[11] Patent Number: 4,561,789

[45] Date of Patent: Dec. 31, 1985

[54] THERMAL INK TRANSFER PRINTING SYSTEM

[75] Inventor: Takashi Saito, Yokosuka, Japan

[73] Assignee: Nippon Telegraph & Telephone Public Corp., Tokyo, Japan

[21] Appl. No.: 623,292

[22] Filed: Jun. 22, 1984

[30] Foreign Application Priority Data

| | | | |
|---|---|---|---|
| Jun. 23, 1983 | [JP] | Japan | 58-111800 |
| Jul. 16, 1983 | [JP] | Japan | 58-128753 |
| Aug. 25, 1983 | [JP] | Japan | 58-154147 |
| Dec. 23, 1983 | [JP] | Japan | 58-242073 |
| Jan. 7, 1984 | [JP] | Japan | 59-526 |

[51] Int. Cl.[4] ..... B41J 3/12; B41J 3/20; B41J 27/20

[52] U.S. Cl. ..... 400/120; 400/121; 346/76 PH; 346/140 R; 346/141; 219/216; 101/114

[58] Field of Search ..... 101/103, 109, 211, 327, 101/335, 368, 426, DIG. 1, DIG. 2, DIG. 15; 400/118, 119, 120, 121; 346/76 R, 76 PH, 140 R, 140 PD, 141; 219/216; 401/2

[56] References Cited

U.S. PATENT DOCUMENTS

| | | | |
|---|---|---|---|
| 2,272,780 | 2/1942 | Schweyer | 401/2 |
| 2,288,015 | 6/1942 | Mumma | 101/327 |
| 3,298,572 | 1/1967 | Newton | 401/2 |
| 3,321,558 | 5/1967 | Balamuth | 101/327 |
| 3,790,703 | 2/1974 | Carley | 346/140 R |
| 3,986,823 | 10/1976 | Mayer | 101/470 |
| 4,164,745 | 8/1979 | Cielo | 346/140 R |
| 4,472,723 | 9/1984 | Shibata | 400/120 |

FOREIGN PATENT DOCUMENTS

| | | | |
|---|---|---|---|
| 265269 | 4/1912 | Fed. Rep. of Germany | 401/2 |

OTHER PUBLICATIONS

Hendriks, Ink Spitter for Hot Melt Ink, Aug. 1983, vol. 26, No. 3A, p. 947.

Hawley, The Condensed Chemical Dictionary, Van Nostrand Reinhold Company, 1981, p. 833.

*Primary Examiner*—Edgar S. Burr

*Assistant Examiner*—William L. Klima

*Attorney, Agent, or Firm*—Armstrong, Nikaido, Marmelstein & Kubovcik

[57] ABSTRACT

A thermal ink transfer printing system comprising an ink material selected from the group consisting of thermal meltable inks and thermal sublimatable inks, a container for such ink material, at least a part of one wall of the container being a filter material, a heater for heating the ink adjacent the filter in the selected pattern to be printed and activating the ink in the selective pattern to pass through the filter holes in the pattern and print such pattern on a paper adjacent the filter.

18 Claims, 14 Drawing Figures

THERMAL INK TRANSFER PRINTING SYSTEM

BACKGROUND OF THE INVENTION

The present invention relates to an improvement of a thermal ink transfer printing system, for the use of, for instance, facsimile and/or a printer, and, in particular, relates to such a system which may print color picture.

A thermal ink transfer printing system has the advantages, among others, that it has less mechanical moving members, the printing noise is low, the size of an apparatus is small, and it operates with low power voltage. Therefore, such printer has been utilized in a various kind of recording and/or printing systems.

FIG. 1 shows the principle of a conventional ink transfer printer. The numeral 1 is an ink film or a ink ribbon, 2 is a recording paper, 3 is a thermal printing head, 4 is a heater mounted in the thermal printing head 3, and 5 is a platen roller. The ink film 1 includes the lamination of the support film 1*a* of, for instance, polyethylene tere-phthalate film, and ink layer 1*b* painted on support film 1*a*. The ink film 1 and paper 2 are pressed on thermal printing head 3 by platen roller 5. When heater 4 of thermal printing head 3 is heated according to the picture pattern to be printed, ink layer 1*b* at thermal printing head 3 is selectively melted and transferred to the paper 2. Thus, the ink pattern is printed on paper 2. In operation, both paper 2 and ink film 1 move so that a fresh ink layer is always provided for fresh printing.

FIG. 2 shows a cross section of a conventional thermal printing head 3, and the numeral $3_1$ is a ceramic substrate, $3_2$ is a glaze layer, $3_3$ is a resistor (heater) layer, $3_4$ is an electrode, $3_5$ is a protection layer for preventing wearing and oxidization of a resistor layer $3_3$. The structure of the thermal printing head of FIG. 2 is the same as that which is used for a conventional thermal printer which uses a thermosensitive paper.

However, a conventional ink transfer printing system has the disadvantages that a moving means for moving an ink film 1 must be provided, and that an ink film can't be used twice. Therefore, a conventional printer must have means for winding up a used ink film, or at least a used ink film must be taken out of the printer apparatus. Although a recording paper 2 is relatively inexpensive, an ink film 1 is expensive. Therefore, the total running cost of the printer is high, and further, it is troublesome to mount and take off an ink film 1. Further, an ink film 1 is wrinkled because of thin film (which is 5–20 μm in thickness), and in that case, the printing quality is considerably decreased.

It should be noted that the disadvantages of the conventional ink transfer printer mentioned above come from the structure through which the ink film must move. The Japanese patent laid open publication No. 178784/82 has proposed a printer which does not move an ink film. FIG. 3 shows the structure of the printer of that Japanese patent laid open publication.

In FIG. 3, the ink roller 6 rotates, and the pre-heater 7 is located close to the ink roller 6, and the thermal printing head 3 confronts with the ink roller 6. A recording paper 2 is located between the ink roller 6 and the thermal printing head 3, and the thermal printing head 3 presses the ink roller 6 through the paper 2. The numerals 8 and 9 in FIG. 3 are guides for moving the paper 2, and 10 is a protection cover. The ink roller 6 is made of sintered metal, which has fine pin holes including thermosensitive ink with dye, paint, wax, and/or some additives. The ink roller 6 is pre-heated by the pre-heater 7 so that the ink included in the roller 6 does not attach on the paper 2. The thermal printing head 3 heats the roller 6 selectively so that the ink is melted, and the melted ink is transferred to the paper 2. The ink roller 6 can be used for a long time, since the ink comes to the surface of the same from the inner holes.

The printer in FIG. 3 has the disadvantages that the head capacity of a thermal printing head must be large due to the heat loss of the thermal printing head which heats the ink roller through a paper with 50–80 μm of thickness, and the printing resolution is small due to the thermal diffusion through the paper.

SUMMARY OF THE INVENTION

It is an object, therefore, of the present invention to overcome the disadvantages and limitations by providing a new and improved thermal printing system.

It is also an object of the present invention to provide a thermal ink transfer printing system which does not use an ink film, can print with small printing power, and provides clear print.

The above and other objects are attained by a thermal ink transfer printing system comprising an ink material held in a container, a heat generation means for converting the ink material from solid non-active status to active status by applying thermal power to the ink material selectively according to the pattern to be printed. The ink material in active status is tranferred to a paper through holes of a filter or porous thermal printing head. The ink material is thermal meltable of thermal sublimatable.

Preferably, the heat generation means is a porous thermal printing head which doubles as a filter.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 4:
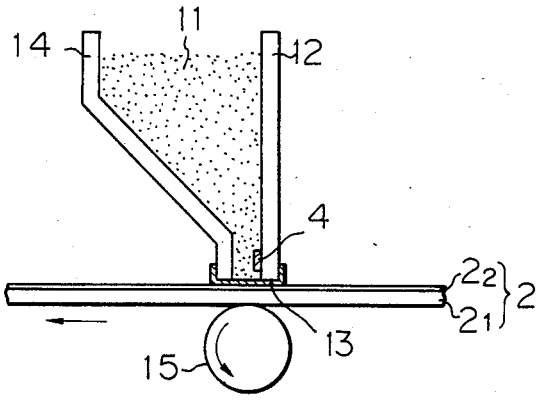
FIG. 4 shows the structure of a thermal ink transfer printing system according to the present invention.

FIG. 4 shows the structure of the thermal ink transfer printing system according to the present invention. In FIG. 4, an ink container is surrounded by the side wall 14 and the substrate of the thermal printing head 12 as a heat generation means, together with the fiber 13 which is positioned close to the thermal printing head 12. The ink material 11 is held in said ink container and has a low melting point, or the ink is sublimatable. The ink material 11 has two states, solid non-active status at low temperature, and liquid (or gaseous) active status at high temperature for printing. The heater 4 which is mounted at the end of the thermal printing head 12 has a plurality of heater cells which are positioned in the perpendicular direction of the drawing. The thermal printing head 12 activates the ink material by converting the status of the same from the non-active status to active status by heating the same. The recording paper 2 is pressed to the filter 13 by the platen roller 15. The recording paper 2 is, preferably, made of base paper $2_1$ and the surface layer $2_2$ which depends upon the kind of the ink material 11. In some particular cases, the surface layer $2_2$ is removed, depending upon the ink material 11. The filter 13 is a thin film with thermal stability, having a plurality of pin holes or mesh with the diameter less than 60 μm, and the thickness of the filter is preferably less than 100 μm. The ink material 11 has high viscosity at room temperature, and can't pass through the filter 13, and, at high temperature, the ink is melted or sublimated, and then, the ink passes through the filter 13, and reaches the recording paper 2 which is printed by said ink.

Therefore, the desired pattern is printed on the recording paper, by heating the heater cells of the thermal printing head 12 selectively to heat (and melt) the ink 11 selectively.

Figure 1:
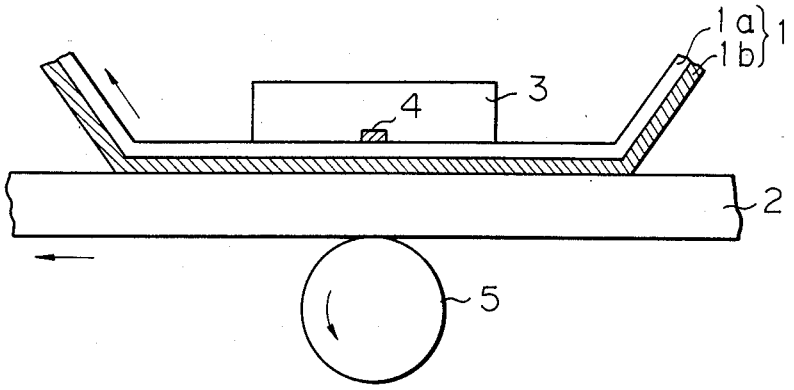
Fig. 1 PRIOR ART
FIG. 1 shows a structure of a prior thermal ink transfer printer.
Figure 2:
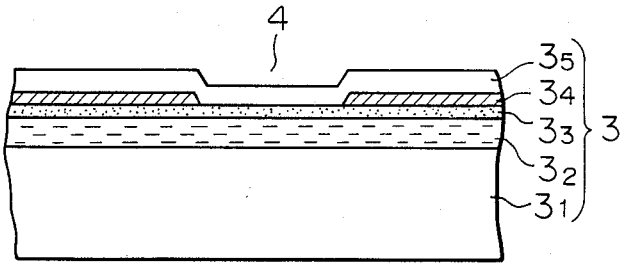
Fig. 2 PRIOR ART
FIG. 2 is a structure of a prior thermal printing head.
Figure 3:
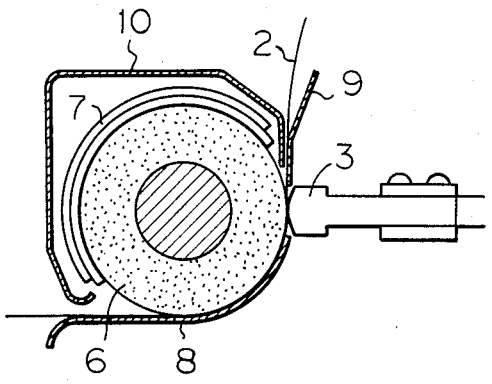
Fig. 3 PRIOR ART
FIG. 3 is a structure of another prior thermal ink transfer printer.
Figure 5A:
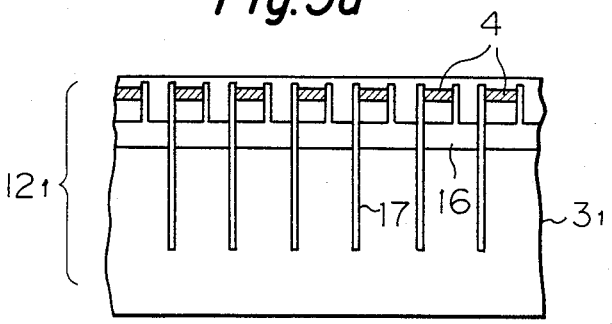
FIGS. 5*a* and 5*b* show structure of the thermal printing head according to the present invention.
Figure 5B:
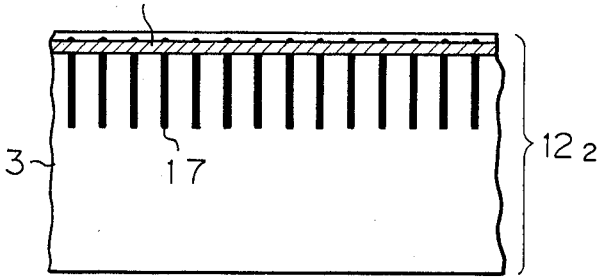

FIGS. 5*a* and 5*b* show embodiments of a thermal printing head 12 in FIG. 4. The first embodiment $12_1$ of the thermal printing head in FIG. 5*a* has a plurality of separated heater cells 4 arranged linearly at the end of the substrate $3_1$. Each heater cell 4 is made of a thin film resistor or a thick film resistor, and is heated by applying voltage between the common electrode 16 and the individual electrode 17 which is provided for each cell. An individual electrode 17 is provided by the number as the same as that of the heater cells 4, which heat the ink 11 selectively according to the applied voltage for the desired printing pattern. The structure of the thermal printing head $12_1$ is the same as that of a prior art, except that heater cells 4 are arranged at the peripheral (end) portion of the substrate (while a prior thermal head has heater cells at inner of central portion of a substrate). The substrate is for instance a glazed ceramic substrate which doubles as both the substrate $3_1$ and the glazed layer $3_2$, and the heater cells 4 made of $Ta_2N$, or Si—Ta, the electrode $3_4$ made of Au, Al, or Cu, and the protection layer $3_5$ (see FIG. 2) made of $Ta_2O_5$, or SiC or deposited on the substrate through sputtering or evaporation process. Of course, the heater cells 4 is deposited through photolithoetching process. The density of the heater cells is for instance in the range between 4 dots/mm and 16 dots/mm. The reason why the heater cells are located at the peripheral portion of the substrate is that the heater cells 4 are located close to the filter 13 as shown in FIG. 4. It should be appreciated in FIG. 5*a* that the common electrode 16 is insulated from the individual electrodes 17 by a thin insulation film (for instance polyimide material) sandwiched between a common electrode 16 and the individual electrodes 17.

FIG. 5*b* is another embodiment of a thermal printing head $12_2$, which is made of a single elongated heater line 4. The electrode 17 is coupled with that heater line 4 with the predetermined interval, and said electrode 17 doubles as both a common electrode and an individual electrode. The current is provided in the heater line 4 through the adjacent pair of electrode 17. The structure of FIG. 5*b* has the feature that the manufacturing process of a thermal printing head is simple.

Figure 6:
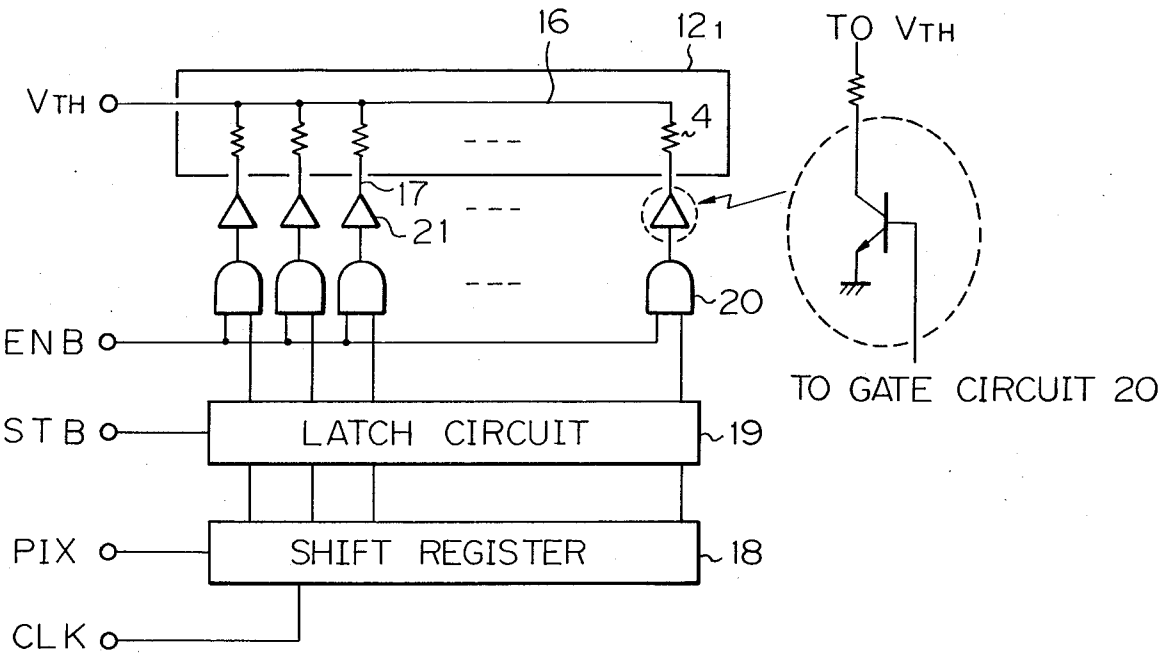
FIG. 6 shows a circuit diagram of the power supply circuit to the thermal printing head according to the present invention.

FIG. 6 shows a circuit diagram of a power supply circuit to a thermal printing head used in the present invention in FIG. 5*a*. In FIG. 6, a picture signal (PIX) for each scanning line is applied to the shift register 18 synchronized with a clock pulse (CLK), then, the content of the shift register 18 is transferred to the latch circuit 19 in parallel by the strobe signal (STB). Then, the enable signal (ENB) is applied to the gate circuits 20 so that each cell of the latch circuit 19 conducts current in a heater cell 4 through the gate circuit 20 and the buffer circuit 21 to generate heat in the selected heater cell 4. One end of the heater cells 4 is coupled commonly with the predetermined potential $V_{TH}$ by the common line 16. The heater cells 4 are arranged linearly along the width directing of a recording paper. In a G3 facsimile system, for instance, the density of the heater cells is 8 dots/mm, and the total number of the cells is 1728 dots (ISO, A4 size paper).

Figure 7A:
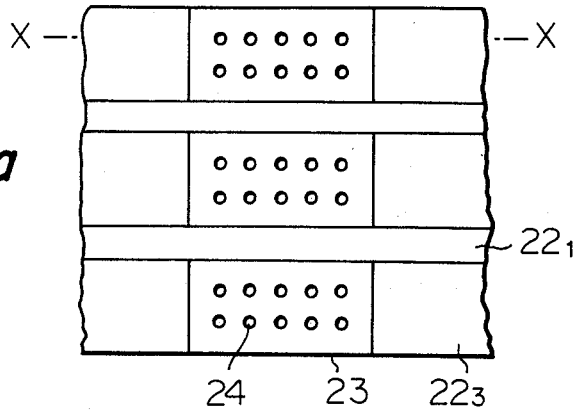
FIGS. 7*a* and 7*b* show structure of a porous thermal printing head for the use of another embodiment of the thermal ink transfer printing system according to the present invention.
Figure 7B:
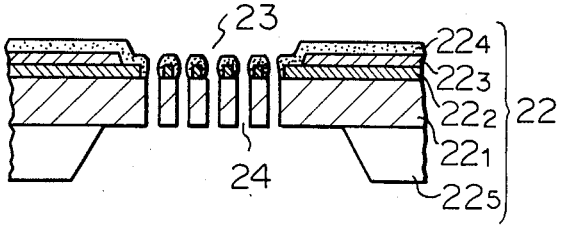

FIG. 7 shows another embodiment of a heat generation means in which FIG. 7*a* is a plane view, and FIG. 7*b* is a cross section at the line X—X in FIG. 7*a*. The thermal printing head of FIG. 7 is called a porous thermal printing head 22 which functions as both the filter 13 and the thermal printing head 12 in FIG. 4.

In FIG. 7, the numeral 22 is a porous thermal printing head, $22_1$ is a substrate, $22_2$ is a resistor (heater) layer, $22_3$ is an electrode, $22_4$ is a protection layer, $22_5$ is a support board, 23 is a heater cell, 24 is a hole for passing ink. The substrate $22_1$ must be heat-proof, and is, for instance, made of porous ceramics, porous glass, or flexible substrate of polyimide film. The substrate $22_1$ may be porous either at the whole area, or only at the portion where a heater cell 23 is provided as shown in FIG. 7. The latter structure is preferable for the mechanical strength and/or the manufacturing yield rate. The resistor layer $22_2$ is made of thin film of $Ta_2N$, Si—Ta, or Ta—$SiO_2$, or thick film of $RuO_2$, as in the case of a prior thermal head. When the heater is made of thin film which is less than 0.3 μm in thickness, the diameter of a hole 24 for passing ink is to be made larger than said thickness of the film so that a hole is not filled with resistor material in sputter or evaporation process for depositing a thin film resistor layer. In case that the hole 24 is filled with thin film resistor material, or a thick film resistor layer is used, a mask must be used in etching on the substrate $22_1$. The protection layer $22_4$ is made of $SiO_2$, SiC, or nitrided compound, and is used for preventing oxidation of a resistor layer $22_2$, and for preventing chemical corrosion of a resistor layer $22_2$ by the ink material.

An example of a process for producing a porous thermal printing head 22 on a polyimide substrate $22_1$ is as follows:

(a) A thin film (thickness is 5-30 μm) of polyimide varnish is produced on the support board $22_5$ made of Fe or Cu by a spinner process. Then, the polyimide thin film is thermoset with relatively low temperature (100°-200° C.) for 1-2 hours;

(b) A hole 24 for passing ink is produced on a thermoset polyimide thin film by a photoetching process;

(c) The polyimide thin film is secondarily thermoset with relatively high temperature (200°-400° C.) for 1-2 hours to provide the substrate $22_1$;

(d) The resistor (heater) layer $22_2$ is deposited on said substrate by a sputtering process. The material of the resistor layer is Ta—$SiO_2$ and the thickness of the same is 0.01-0.1 μm.

(e) An electrode $22_3$ made of Au is deposited on the resistor layer by a evaporation process;

(f) Said electrode $22_3$ (step e)) is subject to photolithoetching process so that a heater 23 including the holes 24 for passing ink is formed;

(g) A protection layer $22_4$ made of $SiO_2$ or $Ta_2O_5$ is deposited on the heater layer by a sputtering process; and (h) Finally, the portion close to the heater 23 in the support board $22_5$ is caved by a photolithoetching process.

We manufactured a test sample with the density of heater cell 5 dots/mm with the above process, and the test sample operated without trouble. The experiment shows that the diameter of a hole 24 for passing ink is preferably 2-30 μm. The density of the hole 24 for passing ink is preferably as high as possible in print of the optical density of recorded dots. However, the density of the hole 24 is restricted by the size of a heater 23, the mechanical strength of the heater, and the precision of photolithoetching process. When the substrate $22_1$ is made of polyimide film, the thermal response is slow due to low heat conductivity. That slow thermal response is quickened by providing Au or Cu layer which has high heat conductivity between the support board $22_5$ and the substrate $22_1$.

Figure 8:
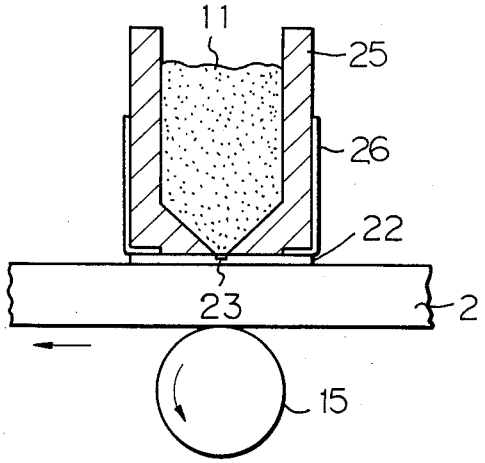
FIG. 8 shows structure of another embodiment of the thermal ink transfer printing system using the porous thermal printing head according to the present invention.

FIG. 8 is the embodiment using the porous thermal printing heat 22 as shown in FIG. 7 according to the present invention, in which the numeral 22 is a porous thermal printing head, 25 is an ink tank, 26 is a flexible printed circuit (FPC) made of polyimide film which is electrically coupled with the electrode $22_3$ of the porous thermal printing head 22. The porous thermal printing head 22 is driven by an external circuit as shown in FIG. 6. It should be noted that the printed circuit 26 may also mount the driving circuit as shown in FIG. 6. When the substrate $22_1$ of the porous thermal printing head is made of polyimide film, the substrate $22_1$ may double as the substrate of the printed circuit 26. The porous thermal printing head 22 in FIG. 8 functions both the filter 13 and the thermal printing head 12 shown in FIG. 4, that is to say, it functions to hold ink and to heat the ink. At room temperature at which the heater cell 23 is not heated, the ink can't pass the hole in the heater cell 23, and therefore, the ink does not transfer to the recording paper 2. On the other hand, at the high temperature in which the heater cell 23 is heated, the ink 11 is melted or sublimated selectively, and the melted ink or sublimated ink passes the hole 24, and transferes to the recording paper 2 to provide a desired pattern on that paper.

Figure 9:
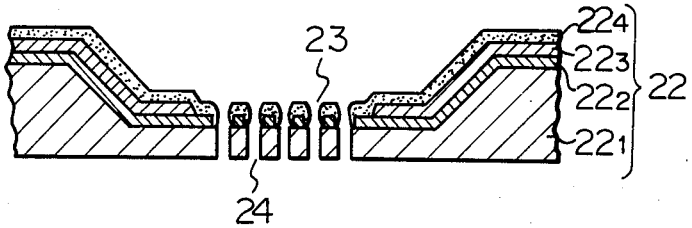
FIG. 9 shows the modification of the embodiment of FIG. 7.

The porous thermal printing head 22 in FIG. 8 has the advantage that the electric power for printing is small compared with FIG. 4, because there is no thermal diffusion loss depending upon the length between the heater 4 and the filter 13 as in the case of FIG. 4. It is preferable that the thickness of the substrate $22_1$ in FIG. 7 is as thin as possible in order to reduce the printing electrical power. However, a thin substrate is mechanically weak, therefore, the substrate $22_1$ is preferably thin only at the portion where the heater cell 23 is formed as shown in FIG. 9. The structure of FIG. 9 has the advantage that the printing power is small, and the mechanical strength of the substrate is not weakened.

Although the embodiments of FIG. 7 and FIG. 9 show that the material of the resistor layer $22_2$ differs from that of the protection layer $22_4$, the present invention is not restricted to those embodiments. When the material of the resistor layer $22_2$ is sufficiently stable, the protection layer $22_4$ is not necessary and is removed. When the resistor layer $22_2$ is made of Si which may provide stable oxide ($SiO_2$), the protection layer $22_2$ is obtained merely by oxidizing the surface of the resistor layer, therefore, no process for sputtering or evaporation for protection layer is necessary. When the resistor layer $22_2$ is made of silicon (Si), in which silicon does not need to be a single crystal silicon, but amorphous silicon can be used.

Figure 10:
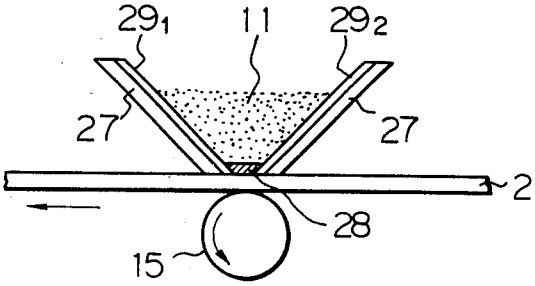
FIG. 10 shows structure of still another embodiment of the thermal ink transfer printer.

FIG. 10 shows still another embodiment of a heat generation means according to the present invention. In the figure, the numeral 27 is the substrate of a printed circuit, 28 is a conductive filter, and $29_1$ and $29_2$ are electrodes. The ink material 11 is meltable or sublimatable, and is held by the printed circuit substrate 27 and the filter 28. The printed circuit substrate 27 is provided with the individual electrode $29_1$ for providing voltage selectively to the selected portion of the filter 28, and the common electrode $29_2$. When the voltage is applied between the selected individual electrode $29_1$ and the common electrode $29_2$, the current flows in the conductive filter 28. Then, the filter 28 is heated, so that the ink close to the heated portion is melted or sublimated, and the melted or sublimated ink passes the filter 28 to reach the recording paper 2. Thus, the ink is transferred to the paper 2, and the desired pattern is printed on the paper. As a modification of FIG. 10, the combination of a conductive ink and non-conductive filter provides the similar operation to that of FIG. 10 in which non-conductive ink 11 and conductive filter 13 are used.

Now, some embodiments of ink material are described.

The first embodiment of ink is thermal meltable semi-solid ink, which may be paste at room temperature, and may have some fluidity. The ink must have the nature that it does not pass a filter 13, or a hole 24 at room temperature. And, the ink has the nature that it increases the fluidity at high temperature, and can pass the filter 13, or the hole 24. It is necessary that the ink has small fluidity at room temperature so that the continuous printing operation is ensured by supplying ink close to the filter or the porous thermal printing head. Further, it is preferable to provide some high pressure to ink by using a piston or air pressure. In our experiment, the preferable characteristics of ink are that the melting temperature is about 60° C., and the viscosity is 50-500 poise (at 25° C.). Those characteristics are obtained by the combination of thermal meltable medium like carnauva wax and oily dye with 5-15 weight %. We experimented with ink formulated with wax of 94 weight % and oily dye of 6 weight %, and confirmed that said ink provides the sufficient optical density of recorded dots. It is preferable in this embodiment that the recording paper 2 has a treated surface layer $2_2$ so that the ink is not blotted on the paper surface, but permeates in the thickness direction of the paper.

The second embodiment of ink is the chemical reactive type semi-solid ink, in which said oily dye in said first embodiment is replaced by color agent which changes color when developed. Therefore, the recording paper 2 must have treated surface coated with developer. When the heater 4 (FIG. 4) or the heater 23 (FIG. 8) is heated, the ink close to the heater is melted, and the melted ink reaches the recording paper through the filter 13, or 28, or the hole 24. Since the paper is coated with the developer, the color agent in the ink reacts with the developer, and provides visible color on the paper. Even when the agent reaches the portion where no printing is desired, it does not provide visible color, if the heat energy is small. That is to say, the colored print is obtained only when (1) the color agent is transferred to the paper which is coated with developer, and (2) the portion to be printed is at high temperature. The necessity of a high temperature for printing prevents a deterioration of printing quality due to blotted ink.

The color agent and the developer may be any chemical agent, so long as the chemical agent itself is transparent or white, but they provide visible color when they react with each other. For instance any chemical agent used for conventional thermosensitive paper with dual chemical agent can be used. For instance, color agent may be leuco dye, and developer may be bisphenol A. Further, sensitizer and/or sticking prevention agent which is conventionally used in a thermosensitive paper may be included in color agent and/or developer. Although the paper in this embodiment is a treated paper, that paper is coated with single layer, and therefore, it can be cheap enough, and the cost is almost the same as that of an ordinary thermosensitive paper.

Another embodiment of the ink is sublimatable colored powder, which is disperse dye with the molecular weight between 200 and 400, and sublimates directly to gas from solid by providing some temperature. It is preferable that the sublimation temperature is lower than 200° C. (static heat temperature), because of the structure of the thermal printing head. In operation, the colored powder is sublimated when heated by a thermal printing head, and the gas thus generated by sublimation reaches the paper where the gas returns to solid state to provide visible pattern on the paper.

When the sublimatable disperse dye is used as ink, the affinity between the ink and the paper should be considered. It should be noted that sublimatable disperse dye does not have good affinity with natural textile which is used as conventional untreated paper, and that dye is not good for optical density of recorded dots, and printing stability. Accordingly, it is preferable that the recording paper be coated with synthetic resin like polyester, nylon, acrylic resin, or acetate fiber which has excellent affinity with sublimation dye.

It should be appreciated that any agent which converts the state quickly from solid state to gas state through liquid state is substantially sublimatable, although it does not convert the state directly from solid state to gas state, and that kind of agent may be used as the ink for the present invention.

The sublimatable ink has the advantage that it can pass a filter without trouble, and provides excellent printing quality and wide gradation range, although the power requirement for printing is somewhat larger than other ink.

Figure 11:
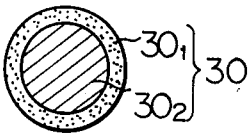
FIG. 11 shows an embodiment of an ink capsule for the use of the present thermal ink transfer printing system.

Still another embodiment of ink is micro-capsule which contains ink. FIG. 11 shows cross section of a micro-capsule 30 which has a capsule shell $30_1$ containing ink $30_2$. The shell $30_1$ is sublimatable, or has low melting temperature. In operation, when a micro-capsule is heated by a thermal printing head, the shell $30_1$ of the capsule 30 is broken by sublimation or melt, and the ink in the capsule comes out of the capsule, then, said ink reaches the paper through the filter or the hole to provide the desired printing pattern.

The shell of the capsule may be made of thermal meltable wax (for instance, carnauva wax), or sublimatabe agent (for instance hexachloroethane). The ink included in the capsule may be dye including water-color ink, oil-color ink, and leuco dye.

A micro-capsule is manufactured through a coacervation process, interfacial polymerization process, or in-situ process which is used for manufacturing conventional no-carbon duplicate paper. Preferably, the diameter of the capsule is larger than the diameter of the hole of the filter.

As described above, a plurality of embodiments of heat generation means, and a plurality of embodiments of ink have been proposed. Any combination of one of said heat generation means, and one of said ink is availabe in the present invention.

Figure 12:
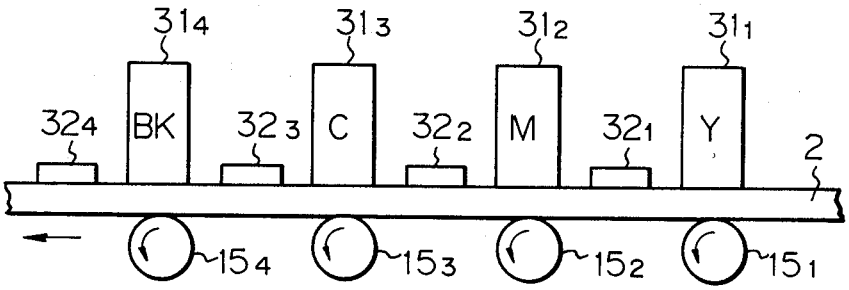
FIG. 12 shows structure of the application of the present thermal ink transfer printing system for the use of color print.

FIG. 12 shows the application of the present invention, in which colored printing is accomplished.

In the figure, the numerals $31_1$ through $31_4$ are line-type printing head units each having yellow (Y) ink, magenta (M) ink, cyan (C) ink, and black (BK) ink. The heater cells of the units $31_1$ through $31_4$ are lined in the perpendicular direction to the paper surface of FIG. 12. The head unit for instance has the structure of FIG. 8 which has the ink tank 25, the porous thermal printing head 22, and the ink 11. Each printing head ($31_1$ through $31_4$) is pressed by the platen roller ($15_1$ through $15_4$) through the paper 2. The present embodiment has four colors which are conventional three primary colors and black. The combination of those colors provides any desired color on the paper. The ink for any color, Y, M, C and BK is conventional and is obvious to those skilled in the art. In the figure, the numerals $32_1$ through $32_4$ are a fixing unit for fixation of ink for preventing color mix. Those fixing units might be removed if the recorded dots by the heads $31_1$ through $31_4$ are sufficiently stable.

As described above in detail, according to the present invention, no ink ribbon or no ink film is necessary for thermal printing, merely by using thermal meltable bulk ink or sublimatable bulk ink. Therefore, the runnning cost of a thermal printer is considerably decreased. Further, the structure of a thermal printer itself is simplified, since the structure for moving an ink ribbon or an ink film is removed. Further, as a heater of the present invention generates the heat in the ink itself, the thermal efficiency of the thermal printing head is high, and the power for printing is reduced. Further, by using a plurality of colors of ink, a color printer by thermal printing heads is obtained.

From the foregoing it will now be apparent that a new and improved thermal ink transfer printing system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A thermal ink transfer printing system comprising an ink material selected from the group consisting of thermal meltable inks and thermal sublimatable inks in which said ink material at ambient temperature is non-liquid and contains solid ink particles, a container for said ink material, at least a part of one wall of said container being a porous filter material, means for selectively heating said ink material in said container adjacent said filter in the pattern to be printed for activating said ink and causing a portion of said activated ink to be transferred through the plurality of pores in said filter in the selected pattern to be printed and to print the image of said pattern on a paper in front of said filter.

2. A thermal ink transfer printing system according to claim 1, wherein said filter is heat conductive, and said filter is heated selectively according to a pattern to be printed so that ink material close to the heated portion is activated.

3. A thermal ink transfer printing system according to claim 1, said heating means is a thermal printing head which has a plurality of heater cells each of which is heated selectively, and said thermal printing head is located close to said filter.

4. A thermal ink transfer printing system according to claim 1, wherein said ink material is thermal meltable ink.

5. A thermal ink transfer printing system according to claim 1, wherein said ink material is thermal sublimatable ink.

6. A thermal ink transfer printing system according to claim 1, wherein said ink material is a micro capsule which has ink in a shell.

7. A thermal ink transfer printing system according to claim 1, wherein said printing paper is coated with a synthetic layer having affinity with said ink material, and said synthetic layer is one selected from polyester, nylon, acrylic resin, and acetate.

8. A thermal ink transfer printing system according to claim 1, wherein a plurality set of colored ink material, and a plurality set of printing heads are provided for color printing.

9. A thermal ink transfer printing system comprising an ink material selected from the group consisting of thermal meltable inks and thermal sublimatable inks in which said ink material at ambient temperature is non-liquid and contains solid ink particles, a container for said ink material, at least a part of one wall of said container being a porous thermal printing head, means for selectively applying electric current to said printing head for heating said head in the pattern to be printed and for activating said ink adjacent said head in said pattern and for causing said activated ink in said pattern to be transfered through the heated pores in said pattern to a paper in front of said head and thereby print said selected pattern on said paper.

10. A thermal ink transfer printing system according to claim 9, wherein said porous thermal printing head has substrate made of polyimide material, and heater layer deposited on said substrate.

11. A thermal ink transfer printing system according to claim 10, wherein the thickness of said substrate is thin at portion where heater cells of the porous thermal printing head are formed, as compared with portions where no heater cell of the thermal head is provided.

12. A thermal ink transfer printing system according to claim 9, wherein said porous thermal printing head is covered with a protection layer, so that the heater cells are protected from chemical corrosion.

13. A thermal ink transfer printing system according to claim 9, wherein said ink material is thermal meltable ink.

14. A thermal ink transfer printing system according to claim 9, wherein said ink material is colored thermal sublimatable ink.

15. A thermal ink transfer printing system according to claim 9, wherein said paper is coated with synthetic layers having affinity with said ink material, and said synthetic layer is one selected from polyester, nylon, acrylic resin, and acetate.

16. A thermal ink transfer printing system according to claim 9, wherein said ink material is a micro capsule which has a ink in a shell.

17. A thermal ink transfer printing system according to claim 9, wherein a plurality set of colored ink material, and a plurality set of printing heads are provided for color printing.

18. A thermal ink transfer printing system according to claim 4, wherein the ink viscosity at 25° C. is not substantially less than 50 and not substantially more than 500 poise.

* * * * *